US007873310B2

(12) United States Patent
Yokota

(10) Patent No.: US 7,873,310 B2
(45) Date of Patent: Jan. 18, 2011

(54) OBLIQUE MOVEMENT PREVENTING DEVICE FOR ENDLESS BELT AND IMAGE FORMING APPARATUS WITH IT

(75) Inventor: Yasuhiro Yokota, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1024 days.

(21) Appl. No.: 11/563,433

(22) Filed: Nov. 27, 2006

(65) Prior Publication Data

US 2007/0147894 A1 Jun. 28, 2007

(30) Foreign Application Priority Data

Nov. 29, 2005 (JP) ..... 2005-343908

(51) Int. Cl.
*G03G 15/01* (2006.01)

(52) U.S. Cl. ..... 399/302; 399/303

(58) Field of Classification Search ..... 399/162, 399/297, 303, 308, 312, 313, 319, 302
See application file for complete search history.

(56) References Cited

U.S. PATENT DOCUMENTS 3,785,542 A * 1/1974 Edes et al. ..... 226/22
6,678,493 B2 * 1/2004 Maeyama et al. ..... 399/302
6,776,280 B2 * 8/2004 Hovstø et al. ..... 198/806

FOREIGN PATENT DOCUMENTS

| | | |
|---|---|---|
| JP | 6-9096 | 1/1994 |
| JP | 9-197907 | 7/1997 |
| JP | 2002-2999 | 1/2002 |
| JP | 2002-91185 | 3/2002 |
| JP | 2003-228222 | 8/2003 |

* cited by examiner

*Primary Examiner*—David M Gray
*Assistant Examiner*—Gregory H Curran
(74) *Attorney, Agent, or Firm*—Oblon, Spivak, McClelland, Maier & Neustadt, L.L.P

(57) ABSTRACT

An oblique movement preventing device for an endless belt, the inner surface of the belt supported by rollers, and at least one roller circulating the belt on the rollers, includes a contact angle changing unit. The changing unit selectively presses either side part of the outer surface of the belt at a position near to the one roller on an upstream side of the one roller in the predetermined belt circulating direction, thereby changing a contact angle of the belt on the one roller along the width direction of the belt. A measuring unit measures a direction and distance of displacement of the belt caused by the oblique movement thereof, and a control unit controls the operation of the changing unit to cease the oblique movement of the belt, based on the measured direction and distance of displacement of the belt.

6 Claims, 4 Drawing Sheets

OBLIQUE MOVEMENT PREVENTING DEVICE FOR ENDLESS BELT AND IMAGE FORMING APPARATUS WITH IT

CROSS-REFERENCE TO RELATED APPLICATIONS

This application is based upon and claims the benefit of priority from prior Japanese Patent Application No. 2005-343908, filed Nov. 29, 2005, the entire contents of which are incorporated herein by reference.

BACKGROUND OF THE INVENTION

1. Field of the Invention

The present invention relates to an oblique movement preventing device for an endless belt and an image forming apparatus with it.

2. Description of the Related Art

An electrophotographic type image forming apparatus is widely known. An image forming apparatus of this system includes an image forming unit that forms a desired image and a recording medium directly conveying device that directly conveys a recording medium (for example, a paper sheet) to the image forming unit. Then, the desired image formed in the image forming unit is directly transferred to the recording medium directly conveyed from the recording medium directly conveying device to the image forming unit. Alternatively, the image forming apparatus of this system includes a combination of an image holding device and a recording medium indirectly conveying device in place of the recording medium directly conveying device. In this alternative image forming apparatus, the desired image formed in the image forming unit is firstly transferred to the image holding device and then the desired image is transferred from the image holding device to the recording medium conveyed to the image holding device by the recording medium indirectly conveying device.

The image forming unit includes a photosensitive drum which rotates in a predetermined direction, an electrostatic charger, an exposure, a toner developer, a transfer, and a cleaner, which are successively arranged around the photosensitive drum in the predetermined rotating direction of the photosensitive drum.

The electrostatic charger uniformly charges the outer circumferential surface of the photosensitive drum that rotates in the predetermined direction. The exposure exposes the uniformly charged outer circumferential surface of the photosensitive drum to form an electrostatic latent image which corresponds to a desired image on the uniformly charged outer circumferential surface. The toner developer develops the electrostatic latent image on the outer circumferential surface of the photosensitive drum by using the toner. The transfer transfers the toner image on the outer circumferential surface of the photosensitive drum directly to the recording medium directly conveyed to the image forming unit by the recording medium directly conveying device or transfers it to the image holding device. In addition, the cleaner cleans the outer circumferential surface of the photosensitive drum after the toner image is transferred.

In an electrophotographic type image forming apparatus which forms a multicolor image, a recording medium directly conveying device which uses an endless belt or an image holding device which uses an endless belt are employed, and a plurality of image forming units that form image pieces of mutually different colors are arranged along the endless belt.

It is well known that the endless belt may cause oblique movement or meandering. In the event that oblique movement or meandering occurs in the endless belt, a position shift among the image pieces occurs in the multicolor image transferred from the plurality of image forming units to the recording medium conveyed by the endless belt of the recording medium directly conveying device or to the endless belt of the image holding device. Consequently, many techniques for preventing oblique movement of the endless belt have been conventionally proposed.

The most well-known conventional endless belt oblique movement preventing technique is to use at least one spindle-shaped crown roller in a plurality of supporting rollers which support the endless belt. However, in the endless belt used for a long time in combination with the crown roller, the length at the center portion becomes longer than that at each of the both side edge portion. And, the center portion of the endless belt warps as compared to the both side edge portions between the plural supporting rollers.

As a result, minute distortion is generated at a portion of the transferred multiple-color image on the recording medium conveyed by the endless belt of the recording medium directly conveying device or on the endless belt (so-called blanket) of the image holding device, that portion corresponding to the center portion of the endless belt.

In one of the conventional endless belt oblique movement prevention techniques, oblique movement regulating members are in contact with both side edges of the endless belt. However, in this endless belt oblique prevention technique, the both side edges of the endless belt are damaged in a comparatively short period by the sliding contact of the both side edges with the oblique movement regulating members. Reinforcing the both side edges of the endless belt slightly extends a life of the endless belt, but increases the manufacturing cost thereof.

In further one of the endless belt oblique movement preventing techniques, ribs that come in contact with both side ends of the endless belt supporting roller are mounted on the both the both side edges of the inner surface of the endless belt. However, in this endless belt oblique movement preventing technique, it is difficult to accurately mount the ribs at the predetermined positions of the both side edges of the inner surface of the endless belt. In addition, the ribs are easily damaged in a comparatively short period by bringing them in contact with the both ends of the endless belt supporting roller and increase the manufacturing cost of the endless belt.

JP-A 2002-2999 (KOKAI) discloses an endless belt oblique movement preventing device which has one swingably supported endless belt driving roller and an endless belt driving roller tilting mechanism. When the endless belt starts an oblique movement, the tilting mechanism tilts the endless belt driving roller to cancel the oblique movement of the endless belt. The swingably supported endless belt driving roller is applied with rotation force from a motor, which is a rotation driving source, by a rotation force transmitting mechanism. However, transmission of the rotation force by the rotation force transmitting mechanism becomes unstable when the endless belt driving roller is tilted. This means that transfer of the endless belt by the endless belt driving roller becomes unstable. As a result, a positional shift among image pieces and a distortion in a multicolor image transferred to the recording medium conveyed by the endless belt of the recording medium directly conveying device or to the endless belt of the image holding device.

To prevent transmission of rotation force from the rotation force transmitting mechanism from being unstable by the tilt of the endless belt driving roller, both the rotation force transmission mechanism and the motor should be configured to be tilted together with the endless belt driving roller. However, this configuration is complicated and increases the manufacturing cost of the endless belt oblique movement prevention device, and at the same time increases the outside dimensions of the device.

BRIEF SUMMARY OF THE INVENTION

According to one aspect of the present invention, an oblique movement preventing device for an endless belt comprises: an endless belt including both side parts in a width direction of the belt; a plurality of supporting rollers supporting an inner surface of the belt, at least one of the rollers being a driving roller applying a rotation force to the belt and circulating the belt on the rollers in a predetermined circulating direction; a contact angle changing unit configured to selectively press either of the both side parts of an outer surface of the belt at a position near to the driving roller on an upstream side of the driving roller in the predetermined circulating direction of the belt, thereby changing a contact angle of the belt on the driving roller along the width direction of the belt; a measuring unit configured to measure a direction and distance of displacement of the belt caused by the oblique movement of the belt; and a control unit configured to control the operation of the contact angle changing unit to cease the oblique movement of the belt, based on the measured direction and distance of displacement of the belt.

According to one aspect of the present invention, an image forming apparatus comprises: a recording medium conveying device conveying a recording medium; and at least one image forming unit forming image on the recording medium. The conveying device comprises: an endless belt including an outer surface on which the recording medium is placed, an inner surface, and both side parts in a width direction of the belt; a plurality of supporting rollers supporting the inner surface of the belt, at least one of the rollers being a driving roller applying a rotation force to the belt and circulating the belt on the rollers in a predetermined circulating direction; a contact angle changing unit configured to selectively press either of the both side parts of the outer surface of the belt at a position near to the driving roller on an upstream side of the driving roller in the predetermined circulating direction of the belt, thereby changing a contact angle of the belt on the driving roller along the width direction of the belt; a measuring unit configured to measure a direction and distance of displacement of the belt caused by the oblique movement of the belt; and a control unit configured to control the operation of the contact angle changing unit to cease the oblique movement of the belt, based on the measured direction and distance of displacement of the belt.

According to another aspect of the present invention, an image forming apparatus comprises: an image holding device to hold image; at least one image forming unit forming image on the image holding device; and a recording medium conveying device conveying a recording medium to the image holding device and receiving the image from the image holding device to the recording medium. The image holding device comprises: an endless belt including an outer surface on which the image is held, an inner surface, and both side parts in a width direction of the belt; a plurality of supporting rollers supporting the inner surface of the belt, at least one of the rollers being a driving roller applying a rotation force to the belt and circulating the belt on the rollers in a predetermined circulating direction; a contact angle changing unit configured to selectively press either of the both side parts of the outer surface of the belt at a position near to the driving roller on an upstream side of the driving roller in the predetermined circulating direction of the belt, thereby changing a contact angle of the belt on the driving roller along the width direction of the belt; a measuring unit configured to measure a direction and distance of displacement of the belt caused by the oblique movement of the belt; and a control unit configured to control the operation of the contact angle changing unit to cease the oblique movement of the belt, based on the measured direction and distance of displacement of the belt.

DETAILED DESCRIPTION OF THE INVENTION

Figure 1:
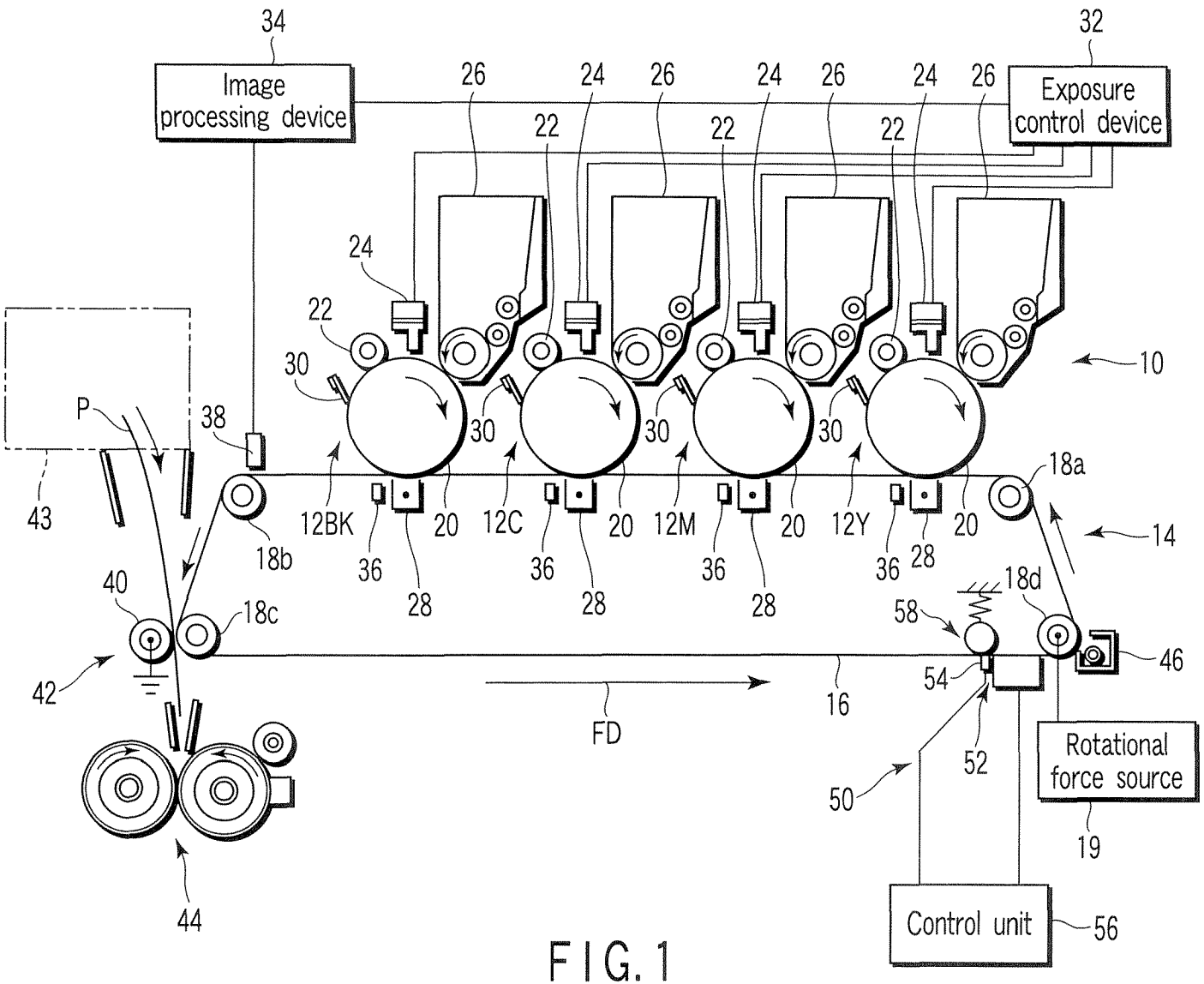
FIG. 1 is a side view schematically showing an electrophtographic type image forming apparatus for forming a multicolor image.

As shown in FIG. 1, an electrophotographic type image forming apparatus 10 for forming a multicolor image includes a plurality of image forming units 12Y, 12M, 12C and 12BK that form image pieces of mutually different colors by an electrophotographic process. The image forming unit 12Y forms a yellow-color image piece, the image forming unit 12M forms a magenta-color image piece, the image forming unit 12C forms a cyan-color image piece, and the image forming unit 12BK forms a black-color image. The respective configurations of the image forming units 12Y, 12M, 12C, and 12BK are the same, and only colors of toners which are used in the units are different from each other.

The image forming apparatus 10 further includes an image holding device 14 on which the multicolor image is formed by the image forming units 12Y, 12M, 12C, and 12BK. The image holding device 14 includes an endless belt 16, the inner surface of which is supported by a plurality of supporting rollers 18*a*, 18*b*, 18*c*, and 18*d* so that the endless belt 16 provides two flat areas being parallel to each other.

One supporting roller 18*d* located at one end of the one flat area (lower flat area in FIG. 1) of the endless belt 16 is connected to a rotation power source 19 such as, for example, a motor and functions as a driving roller which applies a rotation force to the endless belt 16. While the driving roller 18*d* applies the rotation force to the endless belt 16, the endless belt 16 circulates at a predetermined speed in a predetermined direction FD on the plural supporting rollers 18*a*, 18*b*, 18*c*, and 18*d*.

The image forming units 12Y, 12M, 12C, and 12BK are arranged in the predetermined circulating direction FD of the endless belt 16 in this order along the outer surface of the other flat area (upper flat area in FIG. 1) of the endless belt 16.

Each of the image forming units 12Y, 12M, 12C, and 12BK includes a photosensitive drum 20 which rotates at the same peripheral velocity as that of the endless belt 16 in the predetermined circulating direction FD of the endless belt 16. Around the photosensitive drum 20, an electrostatic charger 22, an exposure 24, a toner developer 26, a transfer 28, and a cleaner 30 are successively arranged along the predetermined rotating direction of the photosensitive drum 20.

The electrostatic charger 22 uniformly charges the outer circumferential surface of the photosensitive drum 20 which rotates in the predetermined direction. The exposure 24 is connected to an exposure control device 32, and the exposure control device 32 is connected to an image processing device 34. The exposure control device 32 exposes the uniformly charged outer circumferential surface of the photosensitive drum 20 in accordance with an image forming signal sent from the image processing device 34 and forms an electrostatic latent image piece corresponding to the image forming signal. The toner developer 26 develops the electrostatic latent image piece on the outer circumferential surface of the photosensitive drum 20 with the toner. The transfer 28 is opposed to the outer circumferential surface of the photosensitive drum 20 with the other flat area of the endless belt 16 interposed between them. By applying voltage with the polarity opposite to the charged polarity of the toner image piece on the outer circumferential surface of the photosensitive drum 20 to the transfer 28, the toner image piece on the outer circumferential surface of the photosensitive drum 20 is electrostatically transferred to the outer surface of the other flat area of the endless belt 16. The cleaner 30 removes the toner and the foreign matter remaining on the outer circumferential surface of the photosensitive drum 20 after the toner image piece is transferred.

In the vicinity of the transfer 28 on the downstream side thereof in a moving direction of the other flat area, a de-electrifying device 36 is arranged along the inner surface of the other flat area of the endless belt 16. The de-electrifying device 36 de-electrifies electric charges applied to the inner surface of the other flat area of the endless belt 16 by the transfer 28.

While the endless belt 16 of the image holding device 14 circulates in the circulating direction FD at the predetermined speed, the image forming units 12Y, 12M, 12C, and 12BK form a multicolor image or a monochrome image at a predetermined portion on the outer surface of the endless belt 16 in the other frat area.

An image sensor 38 is arranged to face the downstream end of the other flat area of the outer surface of the endless belt 16. The image sensor 38 reads the multicolor image or the monochrome image formed at the predetermined portion on the outer surface of the endless belt 16, and sends read image signals corresponding to the read image to the image processing device 34. The image processing device 34 adjusts image forming signals to be sent to the exposure control device 32 on the basis of the read image signals, and adjusts a timing of exposing the charged layer on the outer circumferential surface of the photosensitive drum 20 that corresponds to each of the exposures 24 of the image forming units 12Y, 12M, 12C, and 12BK. That is, the image processing device 34 which is combined with the image sensor 38 prevents a positional shift among the image pieces of all colors in the multicolor image formed at the predetermined portion of the outer surface of the endless belt 16 of the image holding device 14.

The supporting roller 18*c* located at the upstream end of the one flat area (lower flat area in FIG. 1) of the endless belt 16 constitutes a secondary transfer 42 together with an earth roller 40 opposing to the outer surface of the upstream end of the one flat area of the endless belt 16. The earth roller 40 is earthed and the supporting roller 18*c* is applied with a voltage of the same polarity as the polarity of the toners of the multicolor image or that of the toner of the monochrome image formed at the predetermined portion of the outer surface of the endless belt 16. This means that the supporting roller 18*c* functions as a transfer roller.

A recording medium (for example, a paper sheet) P is supplied to the upstream end of the outer surface of the one flat area of the endless belt 16 by a recording medium indirectly conveying device (so-called a paper feed device) 43 at a predetermined timing and is pinched by the earth roller 40 and the upstream end of the outer surface of the one flat area of the endless belt 16. As a result, the multicolor image or monochrome image formed at the predetermined portion of the outer surface of the endless belt 16 is electrostatically transferred to a predetermined position of the recording medium (for example, the paper sheet) P by the supporting roller 18*c* serving as the transfer roller at the upstream end of the one flat area of the endless belt 16.

The recording medium (for example, the paper sheet) P, to the predetermined position of which the multicolor image or the monochrome image is transferred by the secondary transfer 42, is pinched, heated and pressurized by a pair of fixing rollers of a fixing device 44 so that the multicolor image or the monochrome image is fixed to the above-mentioned predetermined position. The recording medium (for example, the paper sheet) P with the multicolor image or the monochrome image fixed at the predetermined position by the fixing device 44 is discharged onto a catch tray not illustrated.

A belt cleaner 46 is arranged to face the downstream end of the outer surface of the one flat area of the endless belt 16. The belt cleaner 46 removes the toner and foreign matters remaining on the outer surface of the endless belt 16.

The image forming apparatus 10 includes an oblique movement preventing device 50 for the endless belt 16 of the image holding device 14. The oblique movement preventing device 50 includes a contact angle changing unit 52 in the vicinity of the driving roller 18*d* on the upstream side of the driving roller 18*d* in the circulating direction FD of the endless belt 16 along the outer surface of the one flat area of the endless belt 16. The contact angle changing unit 52 is configured to selectively press either of both side parts of the outer surface of the one flat area of the endless belt 16 at a position close to the driving roller 18*d*. With this manner, the contact angle of the endless belt 16 on the driving roller 18*d* is changed along the width direction of the endless belt 16.

The oblique movement preventing device 50 further includes a measuring unit 54 configured to measure a direction and distance of a displacement of the endless belt 16 caused by the oblique movement of the endless belt 16 at a position close to the driving roller. The oblique movement preventing device 50 further includes a control unit 56 connected to the contact angle changing unit 52 and the measuring unit 54.

The control unit 56 is configured to control the operation of the contact angle changing unit 52 in such a manner as to eliminate the oblique movement of the endless belt 16 on the basis of the direction and the distance of the displacement of the endless belt 16 measured by the measuring unit 54.

The image forming apparatus 10 further includes a warp canceling unit 58. The warp canceling unit 58 is configured to press the inner surface of the endless belt 16 at a position further away from the driving roller 18*d* in a direction opposite to the predetermined circulating direction FD of the endless belt 16 than the position at which either of the both side parts of the outer surface of the endless belt 16 is selectively pressed by the contact angle changing unit 52, in such a manner that the whole length of the endless belt 16 in its width direction is pressed, thereby canceling a warp of the endless belt 16 generated by the press of the contact angle changing unit 52 to either of the both side parts of the outer surface of the endless belt 16.

Figure 2:
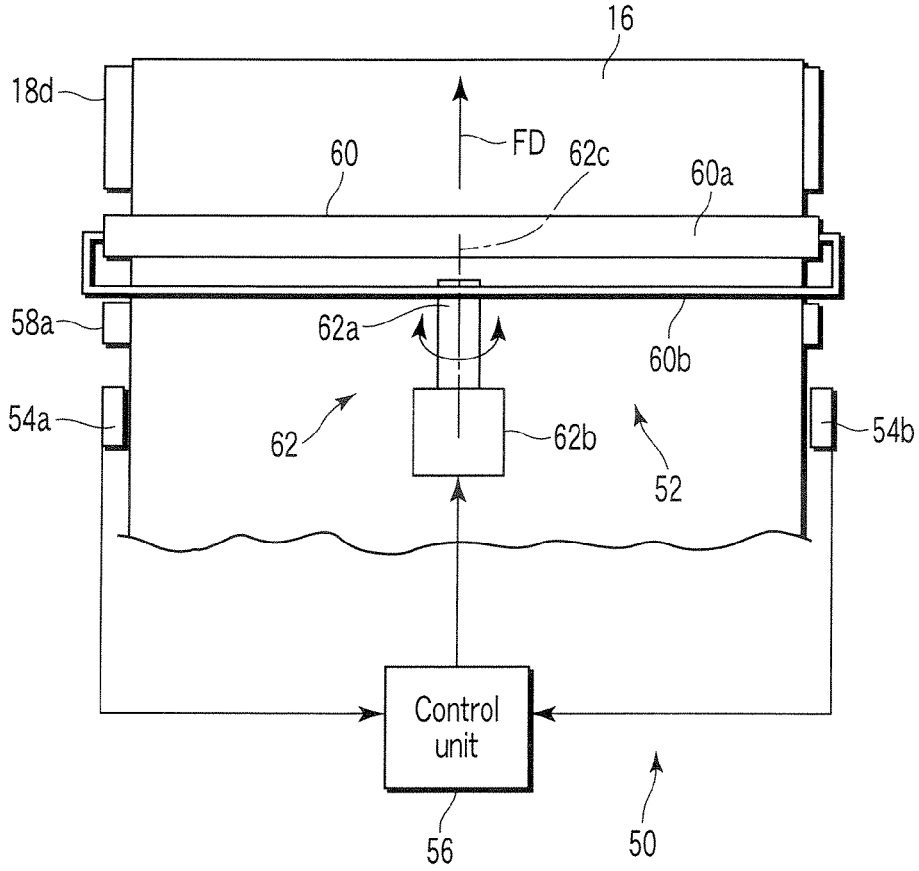
FIG. 2 is a schematic enlarged bottom view of an oblique movement preventing device employed in the image forming apparatus of FIG. 1.
Figure 3:
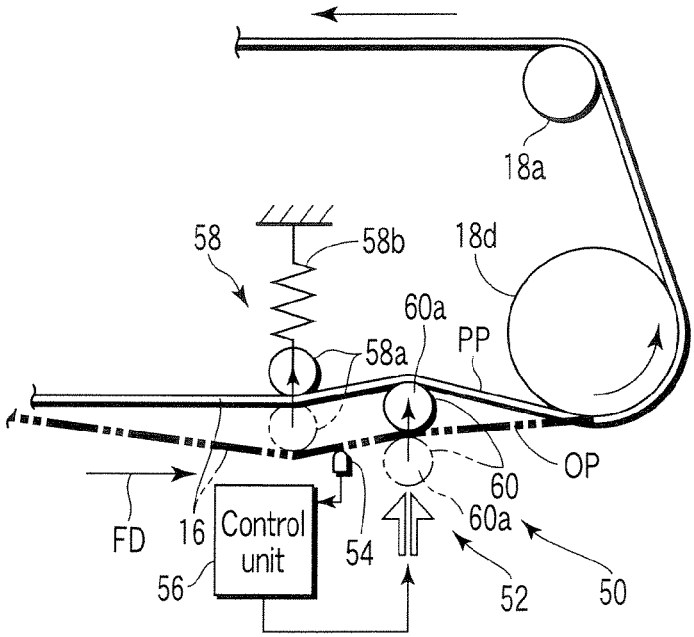
FIG. 3 is a schematic enlarged side view of the oblique movement preventing device of FIG. 2.

FIGS. 2 and 3 illustrate the configuration of the contact angle changing unit 52 and that of the warp canceling unit 58 further in detail.

The warp canceling unit 58 includes a warp suppressing roller 58*a* that presses the inner surface of the one flat area of the endless belt 16 at the position further away from the driving roller 18*d* in the direction opposite to the predetermined circulating direction FD of the endless belt 16 than the position at which either of the both side parts of the outer surface of the endless belt 16 is selectively pressed by the contact angle changing unit 52. The warp suppressing roller 58*a* extends in the width direction of the endless belt 16, and comes in contact with the whole length of the endless belt 16 in its width direction at the above-mentioned far position on the inner surface of the one flat area of the endless belt 16. The warp canceling unit 58 includes an elastic member 58*b* that supports a non-illustrated support, which rotationally supports the warp suppressing roller 58*b*, to a chassis 10*a* of the image forming apparatus 10. The elastic member 58*b* presses the warp suppressing roller 58*a* at the far position on the inner surface of the one flat area of the endless belt 16 with a uniform force along the width direction. As a result, the far position of the one flat area of the endless belt 16 located in the upstream of the driving roller 18*d* in the circulating direction FD is kept flat.

The contact angle changing unit 52 includes a press member 60 which is arranged along the outer surface of the one flat area of the endless belt 16 and extends in the width direction of the endless belt 16 at a position close to the driving roller 18*d* in upstream side of the driving roller 18*d*. The contact angle changing unit 52 further includes a swing source 62 which selectively swings the press member 60 at the position close to the driving roller 18*d* in a direction intersecting with the outer surface of the one flat area of the endless belt 16. The swing source 62 swings the press member 60 as described above to press either of the both side parts of the endless belt 16. While the swing source 62 does not swing the press member 60, the press member 60 is separated from the outer surface of the one flat area of the endless belt 16.

The control unit 56 is configured to control the operation of the contact angle changing unit 52 in such a manner as to eliminate the oblique movement of the endless belt 16 on the basis of the direction and distance of the displacement of the endless belt 16 caused by the oblique movement and measured by the measuring unit 54.

The control unit 56 controls the operation of the swing source 62 in such a manner as to eliminate the oblique movement of the endless belt 16 on the basis of the direction and distance of the displacement of the endless belt 16 caused by the oblique movement and measured by the measuring unit 54.

Specifically, the press member 60 includes a press roller 60*a*, and the contact angle changing unit 52 further includes a press roller supporting member 60*b* which rotationally supports the press roller 60*a*. The swing source 62 includes a swing center shaft 62*a*, and one end of the shaft 62*a* is connected to a position of the press roller supporting member 60*b* corresponding to the center of the one flat area of the endless belt 16 in its width direction. The swing source 62 further includes a swing driver 62*b* which is connected to the other end of the swing center shaft 62*a*, and the swing driver 62*b* may be, for example, a pulse motor. The longitudinal center line (swing center line) 62*c* of the swing center shaft 62*a* extends in the circulating direction FD of the endless belt 16 at the center of the one flat area of the endless belt 16 in its width direction. Accordingly, the swing source 62 can swing the press roller supporting member 60*b* which supports the press roller 60*a* around the swing center line 62*c*.

The measuring unit 54 includes two sensors 54*a*, 54*b* which correspond to the both side parts of the one flat area of the endless belt 16 in its width direction. The measuring unit 54, using the two sensors 54*a*, 54*b*, measures the direction and distance of the displacement of the one flat area of the endless belt 16 in its width direction when the oblique movement of the endless belt 16 is generated.

Figure 4:
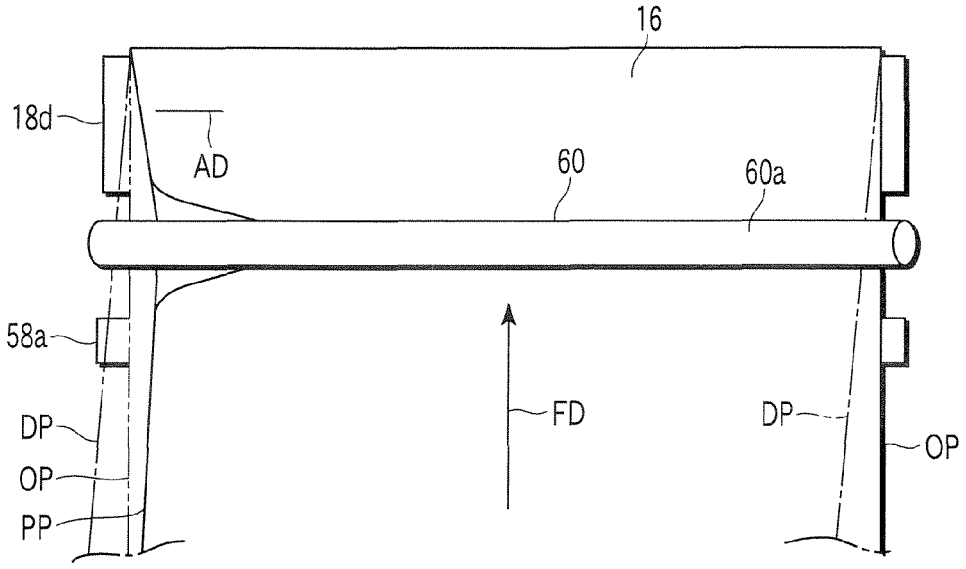
FIG. 4 is an enlarged bottom view schematically showing an operation of the oblique movement preventing device of FIG. 2.

As shown in FIG. 4, in the event that the oblique movement is generated in the endless belt 16 and the both side parts of the one flat area of the endless belt 16 are displaced as shown by the one-dot chain line in its either one (left direction in FIG. 4) width direction from an initial position OP, the displacement direction and displacement distance of each side part of the one flat area of the endless belt 16 from the initial position OP caused by the oblique movement are measured by the two sensors 54*a*, 54*b* of the measuring unit 54 and signals corresponding to these measured values are inputted to the control unit 56.

The control unit 56 controls the operation of the swing driver 62*b* of the swing source 62 on the basis of the measured value signals from the measuring unit 54 in order to eliminate such oblique movement, and swings the press roller supporting member 60*b* in such a manner as to press the press roller 60*a* against one side part (left side part in FIG. 4) of the one flat area of the endless belt 16 located at the leading end in the displacement direction by the oblique movement. By the press of the press roller 60*a* against the one side part (left side part in FIG. 4) of the one flat area of the endless belt 16, the contact angle of the one flat area of the endless belt 16 on the outer circumferential surface of the drive roller 18*d* becomes greater on the one side part than on the other side part in the width direction of the endless belt 16. The one side part (left side part in FIG. 4) of the one flat area of the endless belt 16 at this time is pointed out by a reference symbol PP in FIGS. 3 and 4. As a result, the one side part of the endless belt 16 is displaced in a direction AD opposite to the displacement direction of the both side parts of the one flat area of the endless belt 16 from the initial position OP generated by oblique movement.

The above-mentioned press of the press roller 60*a* against the one side part (left side part of FIG. 4) of the one flat area of the endless belt 16 to eliminate the above-mentioned oblique movement of the endless belt 16 is stopped when the sensor 54*b* (right side in FIG. 3) of the measuring unit 54 located in the returning direction of the endless belt 16 detects that the other side part (right side part in FIG. 4) of the one flat area of the endless belt 16 located at a leading end in the returning direction reaches the initial position OP. That is, the swing driver 62*b* returns the press roller supporting member 60*b* from the above-mentioned swing to the initial position and separates the press roller 60*a* from the outer surface of the one flat area of the endless belt 16.

When the oblique movement of the endless belt 16 occurs in the opposite direction from that shown in FIG. 4, the both side parts of the one flat area of the endless belt 16 move from the initial position OP to the other (right direction in FIG. 4) in the width direction, the control unit 56 controls the operation of the swing driver 62*b* of the swing source 62 reversely to that described before on the basis of the measured value signals from the measuring unit 54 in order to eliminate such oblique movement. That is, the control unit 56 operates the swing driver 62*b* of the swing source 62 to swing the press roller supporting member 60*b* in such a manner as that the press roller 60*a* presses against the other side part (right side part in FIG. 4) of the outer surface of the one flat area of the endless belt 16 located at the leading end in the displacement direction of the endless belt 16 by the oblique movement. By the press of the press roller 60*a* against the other side part (right side part in FIG. 4) of the outer surface of the one flat area of the endless belt 16, the contact angle of the other side part (right side part in FIG. 4) of the one flat area of the endless belt 16 on the outer circumferential surface of the drive roller 18*d* becomes greater than that of the one side part (left side part in FIG. 4). As a result, the one flat area of the endless belt 16 is displaced in the direction opposite to the displacement direction from the initial position OP generated in the both side parts of the one flat area of the endless belt 16 by the above-mentioned oblique movement.

The above-mentioned press of the press roller 60*a* against the other side part (right side part of FIG. 4) of the outer surface of the one flat area of the endless belt 16 to eliminate the above-mentioned oblique movement of the endless belt 16 is stopped when the sensor 54*b* (left side in FIG. 3) of the measuring unit 54 located in the returning direction of the endless belt 16 detects the one side part (left side part in FIG. 4) of the one flat area of the endless belt 16 located at the leading end in the returning direction reaches the initial position OP. That is, the swing driver 62*b* returns the press roller supporting member 60*b* from the above-mentioned swing to the initial position and separates the press roller 60*a* from the outer surface of the one flat area of the endless belt 16.

When the press roller 60*a* is pressed as described above against either one of the both side parts of the outer surface of the one flat area of the endless belt 16 in order to eliminate the above-mentioned oblique movement of the endless belt 16, a warp of the endless belt 16 is generated along the width direction on each of the both sides of the press roller 60*a* in the longitudinal direction of the endless belt 16. However, this warp is cancelled or ceased by the drive roller 18*d* and the warp suppressing roller 58*a* of the warp canceling unit 58, both of which are in contact with the inner surface of the one flat surface of the endless belt 16 on both sides of the press roller 60*a* in the longitudinal direction of the endless belt 16. That is, even when the oblique movement preventing device 50 operates to eliminate the oblique movement of the endless belt 16, the other flat area of the endless belt 16 along the image forming units 12Y, 12M, 12C, and 12BK maintains flat. This means that multicolor image transferred from the image forming units 12Y, 12M, 12C, and 12BK to the other flat area of the endless belt 16 is free from a distortion.

If the oblique movement generated in the endless belt 16 can be successfully cancelled or ceased, the control of the operation of the swing driver 62*b* of the swing source 62 by the control unit 56 on the basis of the measured value signals from the measuring unit 54 can be performed to follow a predetermined relationship between variations of the values of the above measured value signals and variations of the swing rate of the press roller 60*a* by the swing driver 62*b*. Alternatively, this control can be performed by a relationship between simple ON-OFF detection of the above-mentioned measured value signals and a simple ON-OFF swing of the predetermined amount of the press roller 60*a* by the swing driver 62*b*.

Figure 5:
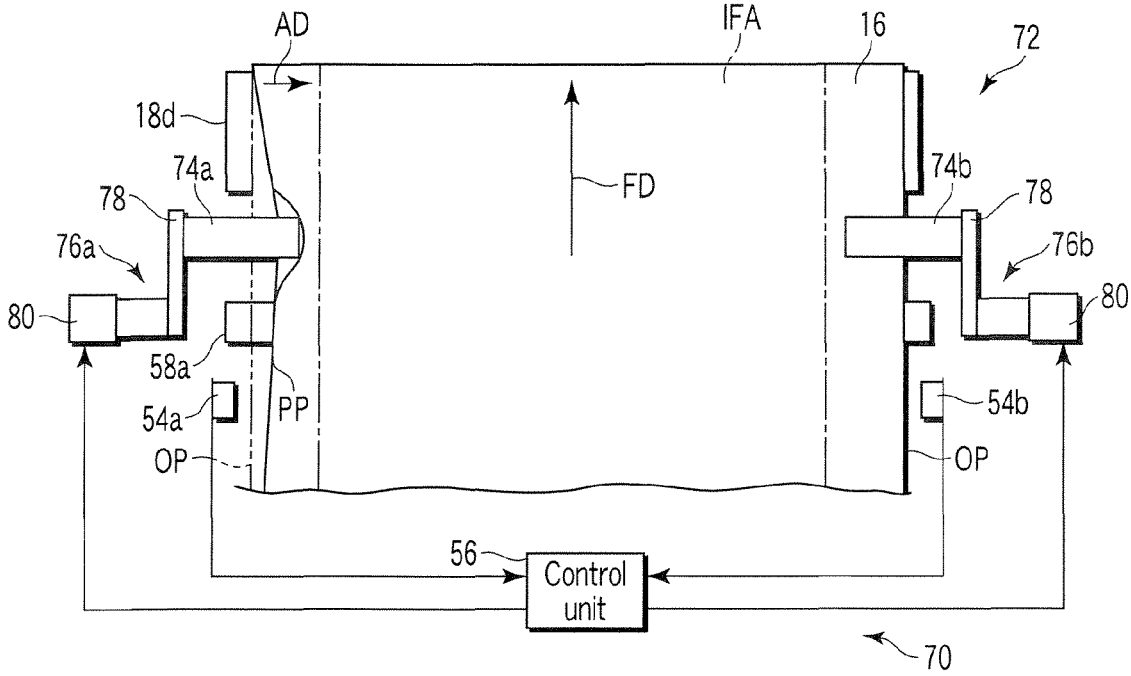
FIG. 5 is a schematic enlarged bottom view of another oblique movement preventing device being employable in the image forming apparatus of FIG. 1.

An enlarged bottom view of another oblique movement preventing device 70 being employable in the image forming apparatus 10 of FIG. 1 is schematically shown in FIG. 5.

A contact angle changing unit 72 of this oblique movement preventing device 70 includes a pair of press members 74*a*, 74*b* facing the both side parts of the outer surface of the one flat area of the endless belt 16 in the vicinity of the drive roller 18*d* on the upstream side of the driver roller 18*d*. The press members 74*a*, 74*b* are selectively movable in a direction intersecting with the outer surface of the one flat area of the endless belt 16 by a pair of press member drivers 76*a*, 76*b*. Respective operations of the pair of press member drivers 76*a*, 76*b* are controlled by the control unit 56. The control unit 56 is configured to control an operation of each of the press member drivers 76*a*, 76*b* of the contact angle changing unit 72 to eliminate an oblique movement of the endless belt 16 on a basis of a direction and distance of displacement of the endless belt 16 which has moved obliquely from the initial position measured by the two sensors 54*a*, 54*b* of the measuring unit 54.

To describe more in detail, each of the press member drivers 76*a*, 76*b* includes a lever 78 extending along each side part of the one flat area of the endless belt 16, and each of the press members 74*a*, 74*b* is connected to one end portion of the lever 78. A rotation source 80 is connected to the other end portion of the lever 78. The rotation source 80 may be, for example, a pulse motor. The control unit 56 is configured to control an operation of the respective rotation forces 80 in such a manner as to eliminate oblique movement of the endless belt 16 on the basis of the measured value signals from the measuring unit 54.

Also in the oblique movement preventing device 70, as in the case of the above-mentioned oblique movement preventing device 50, when an oblique movement is generated in the endless belt 16 and the both side parts of the one flat area of the endless belt 16 move from the initial position OP to one of the above-mentioned width directions (left direction in FIG. 5), measurement value signals concerning the displacement direction and displacement distance of the obliquely moving endless belt 16 measured by the two sensors 54*a*, 54*b* of the measurement unit 54 are inputted in the control unit 56.

The control unit 56 controls the operation of the rotation force 80 of one press member driver 76*a* of the contact angle changing unit 72 which corresponds to one side part (left side part in FIG. 5) of the one flat area of the endless belt 16 located at the leading end in the direction of the displacement caused by oblique movement, on the basis of the measured value signals from the measurement unit 54 in order to eliminate such oblique movement. The rotation force 80 swings the lever 78 in such a manner as to press the press member 74*a* against the one side part (left side part in FIG. 5) of the one flat area of the endless belt 16 located at the leading end in the direction of the displacement caused by the oblique movement.

By the press of the press member 74*a* against the one side part (left side part of FIG. 5) of the one flat area of the endless belt 16, the contact angle of the one side part (left side part of FIG. 5) of the one flat area of the endless belt 16 on the outer circumferential surface of the drive roller 18*d* becomes greater that of the other side part (right side part of FIG. 5) of the one flat area of the endless belt 16. The one side part (left side part in FIG. 5) of the one flat area of the endless belt 16 at this time is designated by reference symbol PP in FIG. 5. As a result, the one flat area of the endless belt 16 is displaced in the direction AD opposite to the displacement direction from the initial position OP generated in the both side parts of the one flat area of the endless belt 16 by the oblique movement.

The above-mentioned press of the press member 74*a* against the one side part (left side part of FIG. 5) of the one flat area of the endless belt 16 to eliminate the above-mentioned oblique movement of the endless belt 16 is stopped when the sensor 54*b* of the measuring unit 54 located in the returning direction (right side in FIG. 5) of the endless belt 16 detects that the other side part (right side part in FIG. 5) of the endless belt 16 located at the leading end in the returning direction reaches the initial position OP. That is, the rotation force 80 of the press member driver 76*a* that corresponds to the one side part (left side part in FIG. 5) of the one flat area of the endless belt 16 returns the lever 78 from the swung position to the initial position and separates the press member 74*a* from the one side part (left side part in FIG. 5) of the outer surface of the one flat area of the endless belt 16.

On the contrary to that described above, when an oblique movement of the endless belt 16 occurs in such a manner that the both side parts of the one flat area of the endless belt 16 move from the initial position OP to the other (right direction in FIG. 5) in the width direction, the control unit 56 controls the operation of the rotation force 80 of the other press member driver 76*b* of the contact angle changing unit 72 which corresponds to the other side part (right side part in FIG. 5) of the one flat area of the endless belt 16 located at the leading end in the direction of the displacement caused by the oblique movement, on the basis of the above-mentioned measured value signals from the measuring unit 54 in order to eliminate such oblique movement. The rotation force 80 swings the lever 78 in such a manner as to press the press member 74*b* against the other side part (right side part in FIG. 5) of the outer surface of the one flat area of the endless belt 16 located at the leading end in the direction of the displacement caused by the oblique movement.

By the press of the press member 74*b* against the other side part (right side part in FIG. 5) of the outer surface of the one flat area of the endless belt 16, the contact angle of other side part (right side part in FIG. 5) of the one flat area of the endless belt 16 on the outer circumferential surface of the drive roller 18*d* becomes greater than that of the other side part (right side part in FIG. 5), the endless belt 16 is displaced in the direction opposite to the displacement direction from the initial position OP generated in the both side parts of the one flat area of the endless belt 16 by the oblique movement.

The above-mentioned press of the press member 74*b* against the other side part (right side part of FIG. 4) of the outer surface of the one flat area of the endless belt 16 to eliminate the above-mentioned oblique movement of the endless belt 16 is stopped when the sensor 54*b* of the measuring unit 54 located in the returning direction (left side in FIG. 5) of the endless belt 16 detects that the one side part (left side part in FIG. 5) of the one flat area of the endless belt 16 located at the leading end in the returning direction reaches the initial position OP. That is, the rotation force 80 of the press member driver 76*b* that corresponds to the other side part (right side part in FIG. 5) of the outer surface of the one flat area of the endless belt 16 returns the lever 78 from the above-mentioned swung position to the initial position and separates the press member 74*b* from the other side part (right side part in FIG. 5) of the outer surface of the one flat area of the endless belt 16.

With the oblique movement preventing device 70 shown in FIG. 5, it is possible to set a length of a portion in each of the both side parts of the outer surface of the one flat area of the endless belt 16 short in the width direction of the endless belt 16, at which either of the press members 74*a* or 74*b* of the press member drivers 76*a*, 76*b* is pressed in order to eliminate the oblique movement of the endless belt 16.

Consequently, there is no possibility that the press members 74*a*, 74*b* are in contact with an image forming area IFA on the outer surface of the endless belt 16, at which an image is formed by the image forming units 12Y, 12M, 12C, and 12BK, and that the press members 74*a*, 74*b* damage the image forming area IFA.

Furthermore, it is also possible to increase a ratio of the length of the image forming area IFA in the width direction of the endless belt 16 to that of the endless belt 16.

Each of the press members 74*a*, 74*b* of the press member drivers 76*a*, 76*b* can be rotationally supported by the other end portion of the lever 78 corresponding thereto. In this case, it is possible to decrease that each of the both side parts of the outer surface of the one flat area of the endless belt 16 is damaged by pressing each of the press members 74*a*, 74*b* against each of the both side parts of the outer surface of the one flat area of the endless belt 16.

Figure 6:
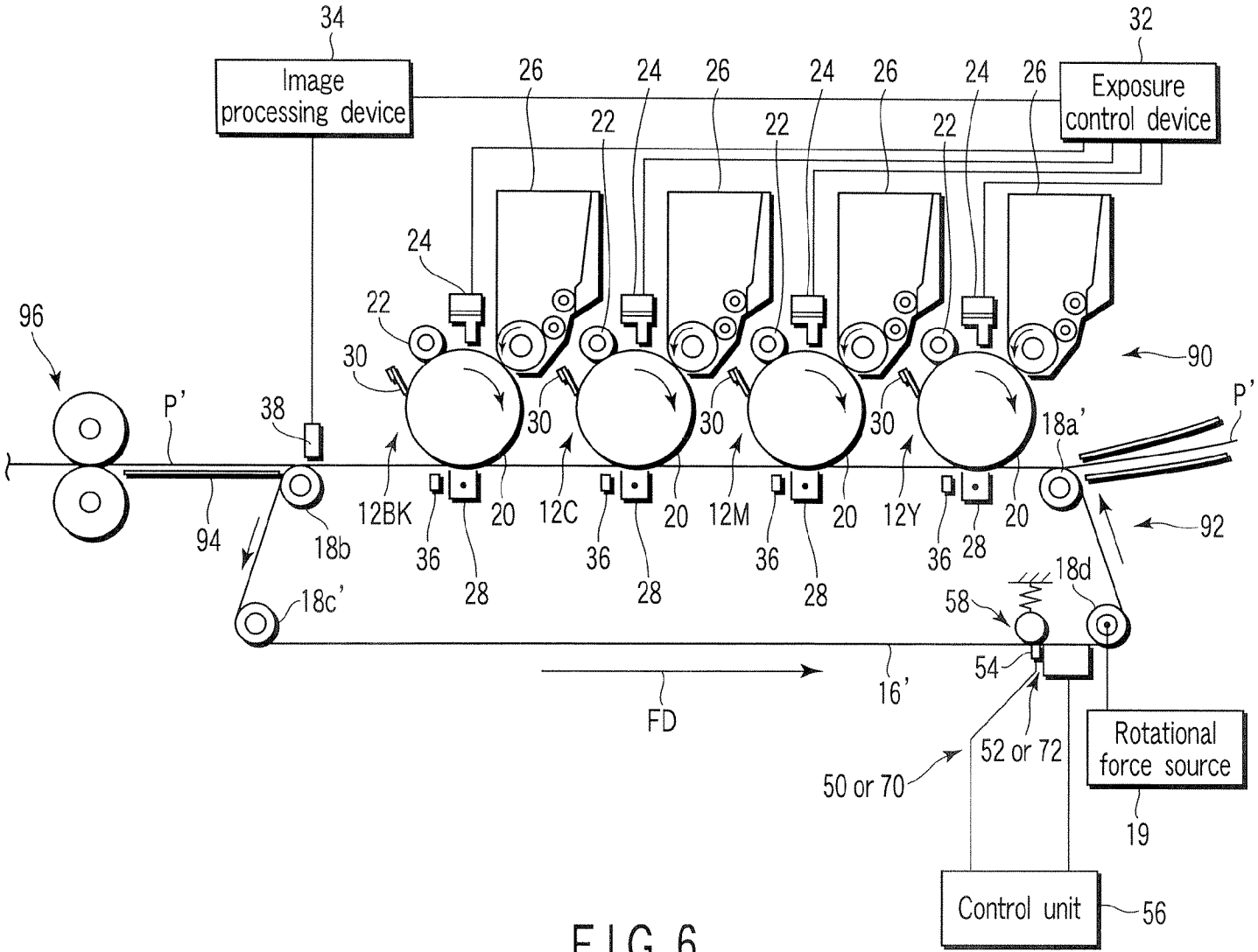
FIG. 6 is a side view schematically showing another electrophtographic type image forming apparatus for forming a multicolor image, the apparatus employing either of the oblique movement preventing devices shown in FIGS. 2 and 5.

FIG. 6 schematically shows another image forming apparatus 90 which can employ either of the oblique movement preventing devices 50 and 70 shown in FIGS. 2 and 5.

The main part of the configuration of the image forming apparatus 90 is the same as that of the image forming apparatus 10 shown in FIG. 1. Consequently, the structural elements of the image forming apparatus 90 which are the same as those of the image forming apparatus 10 are designated by the same reference numerals or symbols as those designating the structural elements of the image forming device 10 corresponding thereto and detailed descriptions thereof will be omitted.

The image forming device 90 is different from the image forming device 10 shown in FIG. 1 in that the image forming device 90 uses a recording medium conveying device 92 that includes an endless belt 16' in place of the image holding device 14 that includes the endless belt 16. In the image forming device 90, image pieces are not formed directly on the outer surface of the endless belt 16' by the image forming units 12Y, 12M, 12C, and 12BK which are arranged along the outer surface of the other flat area of the endless belt 16'. Consequently, a supporting roller 18*c'* arranged at the upstream end of the one flat area of the endless belt 16' is not combined with the earth roller 40 to constitute the secondary transfer 42 and is not applied with voltage of the same polarity as the polarity of the toners of a multicolor image formed by the image forming units 12Y, 12M, 12C and 12BK. Furthermore, no belt cleaner 46 is arranged to face the downstream end of the outer surface of the one flat area of the endless belt 16'.

A recording medium (for example, a paper sheet) P' is supplied to the upstream end of the outer surface of the other flat area of the endless belt 16' of the recording medium transfer device 92 from a paper feed device not illustrated. The supplied recording medium P' is attached to the upstream end of the outer surface of the other flat area of the endless belt 16' by static electricity applied to the endless belt 16' by a non-illustrated static electricity applying device connected to the support roller 18*a'* arranged at the upstream end of the other flat area of the endless belt 16' or in the vicinity on its upstream side. The image forming units 12Y, 12M, 12C, and 12BK form a multicolor image or a monochrome image on the recording medium P' attached to the outer surface of the other flat surface of the endless belt 16' and conveyed from the upstream end of the other flat area of the endless belt 16' to the downstream end thereof by the endless belt 16'.

The recording medium P' with the multicolor image or monochrome image is separated from the outer surface of the other flat area of the endless belt 16' at the downstream end thereof by a recording medium separator 94. The separated recording medium P' is pinched and heated by a pair of fixing rollers of a fixing device 96 to fix the multicolor image or monochrome image on the separated recording medium P'.

The recording medium (for example, the paper sheet) P' with a multicolor image or a monochrome image fixed by the fixing device 96 is discharged onto a catch tray not illustrated.

This image forming apparatus 90 is also equipped with the oblique movement preventing device 50 shown in FIG. 2 or the oblique movement preventing device 70 shown in FIG. 5, for the endless belt 16' of the recording medium conveying device 92, as in the case of the image forming apparatus 10 shown in FIG. 1 which is equipped with either of these preventing devices for the endless belt 16 of the image holding device 14.

An arrangement and operation of the oblique movement preventing device 50 or 70 for the endless belt 16' of the recording medium conveying device 92 in the image forming apparatus 90, are the same as those for the endless belt 16 of the image holding device 14 of the image forming apparatus 10 shown in FIG. 1.

Each of the image forming units 12Y, 12M, 12C, and 12BK used in the above-mentioned image forming apparatus 10 or 90 is of the electrophotographic type, but they may be of an inkjet type or any other publicly known image forming units, as long as a desired image can be recorded on the endless belt 16 of the image holding device 14 of the image forming apparatus 10 or on the recording medium P' attached on the endless belt 16' of the recording medium transfer device 92 for the image forming apparatus 90.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An oblique movement preventing device for an endless belt, the endless belt including an inner surface, an outer surface, and both side parts in a width direction of the belt, the inner surface being supported by a plurality of supporting rollers, at least one of the rollers being a driving roller applying a rotation force to the belt and circulating the belt on the rollers in a predetermined circulating direction, the oblique movement prevention device comprising:

a contact angle changing unit which includes a press roller arranged along the outer surface of the belt and extending in the width direction at a position near to the driving roller in an upstream side of the driving roller in the predetermined circulating direction of the belt, and a swing source selectively swinging the press roller in a direction crossing the outer surface of the belt to make the press roller press either of the both side parts of the belt, thereby changing a contact angle of the belt on the driving roller along the width direction of the belt;

a measuring unit which is configured to measure a direction and distance of displacement of the belt caused by an oblique movement of the belt;

a control unit which is configured to control the operation of the swing source of the contact angle changing unit for the selective swinging of the press roller in the direction crossing the outer surface of the belt to make the press roller press either of the both side parts of the belt, and to cease the oblique movement of the belt, based on the measured direction and distance of displacement of the belt; and a warp canceling unit which includes a warp suppressing roller, and which is configured to make the warp suppressing roller press the inner surface of the belt with an elasticity at a position near to the press roller in an upstream side of the press roller in the predetermined circulating direction of the belt, thereby canceling a warp of the belt caused by the press of the press roller of the contact angle changing unit to either of the both side parts of the outer surface of the belt, so that a part of the belt in the upstream side of the driving roller between the warp suppressing roller and the driving roller keeps flat.

2. The device according to claim 1, wherein the contact angle changing unit further includes a press roller supporting member rotationally supporting the press roller, and the swing source is connected to the supporting member at a position corresponding to a center of the belt in the width direction to swing the supporting member around a swing center line extending along a center line of the belt extending in the circulating direction of the belt at the width directional center of the belt.

3. An image forming apparatus comprising:

a recording medium conveying device conveying a recording medium; and at least one image forming unit forming image on the recording medium, the conveying device comprising:

an endless belt including an outer surface on which the recording medium is placed, an inner surface, and both side parts in a width direction of the belt;

a plurality of supporting rollers supporting the inner surface of the belt, at least one of the rollers being a driving roller applying a rotation force to the belt and circulating the belt on the rollers in a predetermined circulating direction;

a contact angle changing unit which includes a press roller arranged along the outer surface of the belt and extending in the width direction at a position near to the driving roller in an upstream side of the driving roller in the predetermined circulating direction of the belt, and a swing source selectively swinging the press roller in a direction crossing the outer surface of the belt to make the press roller press either of the both side parts of the belt, thereby changing a contact angle of the belt on the driving roller along the width direction of the belt;

a measuring unit which is configured to measure a direction and distance of displacement of the belt caused by an oblique movement of the belt;

a control unit which is configured to control the operation of the swing source of the contact angle changing unit for the selective swinging of the press roller in the direction crossing the outer surface of the belt to make the press roller press either of the both side parts of the belt, and to cease the oblique movement of the belt, based on the measured direction and distance of displacement of the belt; and a warp canceling unit which includes a warp suppressing roller, and which is configured to make the warp suppressing roller press the inner surface of the belt with an elasticity at a position near to the press roller an upstream side of the press roller in the predetermined circulating direction of the belt, thereby canceling a warp of the belt caused by the press of the press roller of the contact angle changing unit to either of the both side parts of the outer surface of the belt, so that a part of the belt in the upstream side of the driving roller between the warp suppressing roller and the driving roller keeps flat.

4. The apparatus according to claim 3, wherein the contact angle changing unit further includes a press roller supporting member rotationally supporting the press roller, and the swing source is connected to the supporting member at a position corresponding to a center of the belt in the width direction to swing the supporting member around a swing center line extending along a center line of the belt extending in the circulating direction of the belt at the width directional center of the belt.

5. An image forming apparatus comprising:

an image holding device to hold image;

at least one image forming unit forming image on the image holding device; and a recording medium conveying device conveying a recording medium to the image holding device and receiving the image from the image holding device to the recording medium, the image holding device comprising:

an endless belt including an outer surface on which the image is held, an inner surface, and both side parts in a width direction of the belt;

a plurality of supporting rollers supporting the inner surface of the belt, at least one of the rollers being a driving roller applying a rotation force to the belt and circulating the belt on the rollers in a predetermined circulating direction;

a contact angle changing unit which includes a press roller arranged along the outer surface of the belt and extending in the width direction at a position near to the driving roller in an upstream side of the driving roller in the predetermined circulating direction of the belt, and a swing source selectively swinging the press roller in a direction crossing the outer surface of the belt to make the press roller press either of the both side parts of the belt, thereby changing a contact angle of the belt on the driving roller along the width direction of the belt;

a measuring unit which is configured to measure a direction and distance of displacement of the belt caused by an oblique movement of the belt;

a control unit which is configured to control the operation of the swing source of the contact angle changing unit for the selective swinging of the press roller in the direction crossing the outer surface of the belt to make the press roller press either of the both side parts of the belt, and to cease the oblique movement of the belt, based on the measured direction and distance of displacement of the belt; and a warp canceling unit which includes a warp suppressing roller, and which is configured to make the warp suppressing roller press the inner surface of the belt with an elasticity at a position near to the press roller in an upstream side of the press roller in the predetermined circulating direction of the belt, thereby canceling a warp of the belt caused by the press of the press roller of the contact angle changing unit to either of the both side parts of the outer surface of the belt, so that a part of the belt in the upstream side of the driving roller between the warp suppressing roller and the driving roller keeps flat.

6. The apparatus according to claim 5, wherein the contact angle changing unit further includes a press roller supporting member rotationally supporting the press roller, and the swing source is connected to the supporting member at a position corresponding to a center of the belt in the width direction to swing the supporting member around a swing center line extending along a center line of the belt extending in the circulating direction of the belt at the width directional center of the belt.

* * * * *